US005236771A

United States Patent [19]

Groshens

[11] Patent Number: 5,236,771

[45] Date of Patent: Aug. 17, 1993

[54] COMPOSITE LINING FABRIC AND PROCESS FOR PRODUCING IT

[75] Inventor: Pierre Groshens, Flamicourt, France

[73] Assignee: Lainiere de Picardie, Peronne, France

[21] Appl. No.: 831,949

[22] Filed: Feb. 6, 1992

[30] Foreign Application Priority Data

Feb. 25, 1991 [FR] France ..... 91 02214

[51] Int. Cl.[5] ..... A41D 27/02; B32B 5/06; B32B 5/26; B32B 7/14

[52] U.S. Cl. ..... 428/198; 2/97; 2/272; 428/286; 428/301

[58] Field of Search ..... 428/198, 286, 301; 2/97, 272

[56] References Cited

U.S. PATENT DOCUMENTS

| | | | |
|---|---|---|---|
| 3,991,246 | 11/1976 | Schneider | 2/272 |
| 4,148,958 | 4/1979 | Tischer et al. | 2/272 |
| 4,196,245 | 4/1980 | Kitson et al. | 428/198 |
| 4,374,888 | 2/1983 | Bornsiagger | 428/198 |
| 4,610,915 | 9/1986 | Crenshaw | 428/219 |
| 4,818,597 | 4/1989 | DaPonte | 428/284 |
| 4,868,928 | 9/1989 | Norvell | 2/272 |
| 5,017,418 | 5/1991 | Groshens | 2/272 |
| 5,034,261 | 7/1991 | Loubinoux et al. | 428/198 |
| 5,061,546 | 10/1991 | Groshens et al. | 2/272 |
| 5,063,101 | 11/1991 | Gryneaus | 2/272 |
| 5,098,770 | 3/1992 | Poire | 2/97 |

FOREIGN PATENT DOCUMENTS

| | | |
|---|---|---|
| 496557 | 9/1976 | Australia . |
| 0333211 | 9/1989 | European Pat. Off. . |
| 0333212 | 9/1989 | European Pat. Off. . |
| 0363254 | 4/1990 | European Pat. Off. . |
| 49101 | 1/1991 | European Pat. Off. . |
| 411656 | 2/1991 | European Pat. Off. . |
| 1460016 | 4/1969 | Fed. Rep. of Germany . |
| 2708156 | 9/1977 | Fed. Rep. of Germany . |
| 41959 | 3/1983 | Japan . |
| 33282 | 2/1989 | Japan . |
| 174660 | 7/1989 | Japan . |
| 289101 | 11/1990 | Japan . |

*Primary Examiner*—James C. Cannon
*Attorney, Agent, or Firm*—Kane, Dalsimer, Sullivan, Kurucz, Levy, Eisele and Richard

[57] ABSTRACT

A lining fabric comprising a first nonwoven layer composed of microfibers produced by melting-blowing, and at least one second nonwoven layer composed of fibers or filaments and an adhesive layer distributed in spots. The first layer and the second layer being bonded, on the one hand, partially by the entanglement of some of the fibers thereof by the application of fluid jets; on the other hand, completely by the base of the spots of the adhesive layer which keeps the fibers interlaced, thus ensuring the cohesion of the assembly as a whole.

8 Claims, 5 Drawing Sheets

COMPOSITE LINING FABRIC AND PROCESS FOR PRODUCING IT

FIELD OF THE INVENTION

The invention relates to a composite lining fabric and a process for producing it.

PRIOR ART

Lining fabrics are intended to be associated with other fabrics or cloths, to which they give a feel, flexibility and liveliness which they do not have in themselves, and which makes it possible to use them effectively in the manufacture of garments.

Various techniques have been developed to make it possible to produce linings having themselves a feel, flexibility and liveliness which are a function of the use for which they are intended.

More particularly, for example, patent application FR-A-2,645,180 relates to a composite lining fabric formed from a knitted or woven textile support and from at least one nonwoven lap. The association of the support and of the lap is obtained by needling with fluid jets.

Moreover, also known is patent application FR-A-2,637,163 which relates to a fusible lining, the textile base of which is a nonwoven formed from synthetic filaments intermingled by means of fluid jets.

The first of these techniques is especially useful because the production of a composite lining makes it possible to select accurately and to control the properties of the lining.

In contrast, the presence in this composite lining of a knitted or woven textile support which affords significant advantages (dimensional stability, resistance to creasing, etc) has the disadvantage, for other uses, of being of relatively high cost. However, the presence of this knitted or woven textile support has hitherto been considered necessary in this type of composite article.

The document EP-A-0,333,212 relates to an elastomeric composite nonwoven obtained by the entanglement by fluid jets of a laminate consisting of at least one layer of "melt-blown" fibers and of at least one additional layer of discontinuous "melt-blown" fibers or of continuous filaments.

Finally, according to European Patent EP-A-0,333,211, there is provided a composite nonwoven likewise formed by fluid jets from a laminate composed of at least on layer of "melt-blown" fibers and of at least one layer of a nonwoven material. The latter can be based on continuous filaments preferably obtained by the melted process "spunbond". This document also relates to the process for producing such a composite nonwoven.

Besides the disadvantages mentioned above, these two documents have the disadvantage of employing a conventional melt-blowing process which brings about a high degree of cohesion with the lap.

Such a process also simultaneously generates a dense layer having a feel which is similar to that of a plastic film and which is incompatible with the textile feel sought for a lining.

SUMMARY OF THE INVENTION

The object of the invention is, therefore, to provide a composite lining, the properties of which can be widely varied and which makes it possible to complement the range of already existing products.

Another object of the present invention is to provide a fusible lining having little risk of passage and return.

Yet another object of the present invention is to provide a composite lining having a good quality/price ratio.

To achieve this, the invention relates to a lining fabric comprising a first nonwoven layer composed of microfibers produced by melt-blowing. According to the invention, the lining fabric comprises at least one second nonwoven layer composed of fibers or filaments and an adhesive layer distributed in spots. The first layer and the second layer are bonded, on the one hand, partially by the entanglement of some of their fibers which is obtained by the application of fluid jets and, on the other hand, completely by the base of the spots of the adhesive layer which keeps the fibers interlaced, thus ensuring the cohesion of the assembly as a whole.

According to an especially advantageous embodiment, the lining fabric of the invention also comprises a third nonwoven layer which can consist either of filaments, for example synthetic filaments obtained by the melted process, or of microfibers produced by melt-blowing. In this case, this third layer is bonded to one of the other two layers likewise by the entanglement of some of their fibers which is obtained by the application of fluid jets.

The invention also relates to a process for producing a composite lining fabric comprising a first nonwoven layer of microfibers and a second nonwoven layer.

According to the invention, the first nonwoven layer of microfibers is produced by melt-blowing and the second nonwoven layer is formed and then placed under the first layer. The first and second layers are intermingled and joined to one another by fluid jets and the two joined layers are then dried.

In a preferred embodiment, the second nonwoven layer is carded, and it is advantageously folded and lapped, before being associated with the first layer.

The second layer is advantageously preneedled. It can consist of a nonwoven voile formed from continuous filaments intermingled without orientation and produced from synthetic material by the melted process, also known by the name of "spunlaid-spunbond".

BRIEF DESCRIPTION OF THE DRAWINGS

The invention will be described in more detail in the following description and with reference to the figures in which.

DESCRIPTION OF THE PREFERRED EMBODIMENTS

Figure 1:
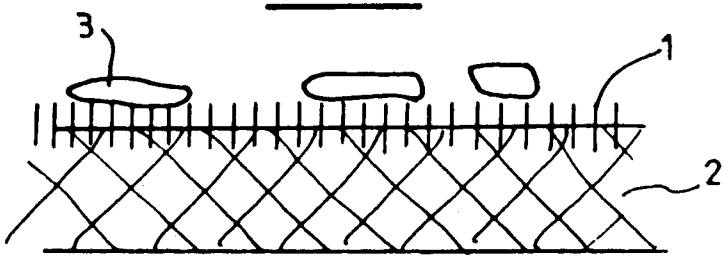
FIG. 1 is a diagrammatic representation of the lining of the invention.

The lining fabric of the invention comprises a first nonwoven layer 1 composed of microfibers produced by melt-blowing. This production process known by the name of "melt-blown" makes it possible to produce a synthetic nonwoven fabric consisting of microfibers. It has a high uniformity and possesses a plane surface obtained as a result both of the fineness of its component fibers and of its production process. The large number of microfibers gives it an excellent cover.

In contrast, in addition to these qualities, the "melt-blown" nonwoven fabric layers have some disadvantages in terms of their use in the sector of linings. In fact, the lining must be resistant to cleaning and to washing. To obtain this resistance, it is necessary to produce the "melt-blown" nonwoven layers with a high air pressure which projects the filaments vigorously onto the receiving belt, thereby giving a high degree of cohesion with the lap. However, at the same time, a high air pressure produces a dense layer having a feel similar to that of a plastic film, this being unsuitable for its use in linings.

For this reason, the first nonwoven layer composed of microfibers and used in the invention is produced by blowing with a relatively low air pressure during the spinning. The distance between the nozzles of the extruder 34 and the receiving blanket 33 acts on the cooling of the fibers, before they are deposited, and thereby on the feel of the lap, at the same time as the air pressure. A distance of the order of or less than 350 mm gives a plastic feel, whereas a distance greater than 500 mm is adopted, preferably for the execution of the invention and affords a textile feel. Thus, this layer is flexible and has a textile feel.

It is formed, for example, from fibers having a linear density of between 0.1 and 0.7 Dtex.

The lining fabric comprises a second nonwoven layer composed of fibers. This layer imparts to the lining its resilience (liveliness) which makes it crease-resistant and gives it its volume, resilience, etc.

The first layer 1 and the second layer 2 are bonded by the entanglement of some of their fibers which is obtained by the application of fluid jets. According to this technique, thin needles of water produced by injectors under high pressure are directed perpendicularly to the two layers previously placed one on top of the other. These fluid jets bring about the entanglement of the microfibers of the first layer 1 in the surface fibers of the second layer 2.

The lining fabric of the invention is fusible. It comprises an adhesive layer 3 distributed in spots on the first nonwoven layer 1, on the face opposite that in contact with the second nonwoven layer 2. These fusible spots contribute to the feasibility of the product. The cohesion of the first nonwoven layer composed of microfibers produced by melt-blowing on another textile support is relatively low, but is improved by the fusible spots which are conducive to the stability of the fibers and allow bonding.

In fact, the first layer 1 and the second layer 2 are bonded, on the one hand, partially by the entanglement of some of their fibers by the application of fluid jets and, on the other hand, completely by the base of the spots of the adhesive layer 3 which keeps the fibers interlaced, thus ensuring the cohesion of the assembly as a whole.

The second nonwoven layer 2 can be composed of carded discontinuous fibers jumbled and of random orientation. The card voile 2 can also have parallel fibers.

It can also be composed of carded fibers bonded by thermal bonding. This bonding contributes to giving the lap cohesion before it is assembled with the first layer 1.

Before its association with the first layer 1, the second nonwoven layer 2 composed of carded fibers can be needled so as to increase its cohesion and rigidity.

This second layer 2 advantageously consists of a nonwoven voile formed from synthetic continuous filaments intermingled without orientation and obtained by the melted process "spunbond".

The linear density of the filaments forming the second nonwoven layer is, in this case, advantageously between 1 and 5 Dtex and preferably equal to 1.5 Dtex.

A third nonwoven textile layer can be associated with the first and second layers 1 and 2. Depending on the intended use and on the liveliness and piercing resistance which the lining is to be given, the third layer can be a lap of carded fibers or consist of synthetic filaments obtained is by the melted process, in which case it is a layer similar to the second. The third layer can, on the contrary, be of the same type as the first, that is to say composed of microfibers produced by melt-blowing. It can be superposed on the first layer or, on the contrary, placed on the other face of the second layer which is thus sandwiched between the two "melt-blown" microfiber layers.

The production process will now be described with reference to FIGS. 2 to 6.

The second layer 2, covered with the first layer 1, is delivered on a conveyor belt 10 which drives them along opposite a first series of injectors 11. After the composite fabric composed of the first two layers has been overturned by means of the rollers 12 of the conveyor belt 13 and the rollers 14, 15 and 16, the composite fabric is brought opposite a second set of injectors 17 which produces fluid jets passing first through the second layer 2. After being deflected by the rollers 18, 19 and 20, the composite fabric is expressed by the rollers 21 and then dried in the oven 22. After drying, the lining thus produced is stored on the roller 23.

Figure 2:
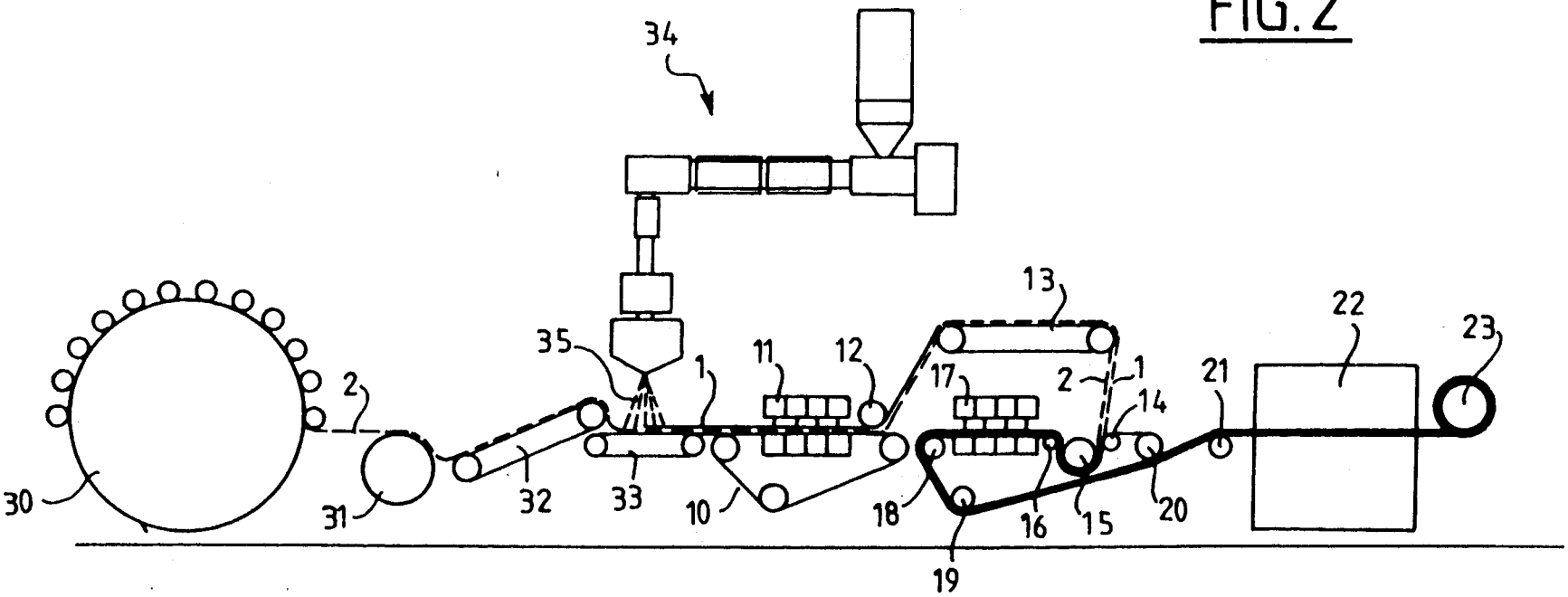
FIG. 2 is a diagrammatic representation of a first embodiment according to the invention.

In the embodiment illustrated in FIG. 2, the second layer 2 is formed on a card 30 and then brought by the roller 31 and the belt 32 onto the belt 33 by way of a melt-blowing extruder represented as a whole by the reference 34. The microfibers 35 formed by melt-blowing extrusion by the extruder 34 form the layer 1 directly on the second layer 2.

Preferably, the layer 1 is formed by the "melt-blown" process from polyamide or polyester. Its weight is between 5 and 80 g/m$^2$. The second fiber layer 2 is a lap of carded fibers of random orientation, the weight and composition of which vary according to the desired effect.

The second fiber layer can be a lap of parallel carded fibers.

Figure 3:
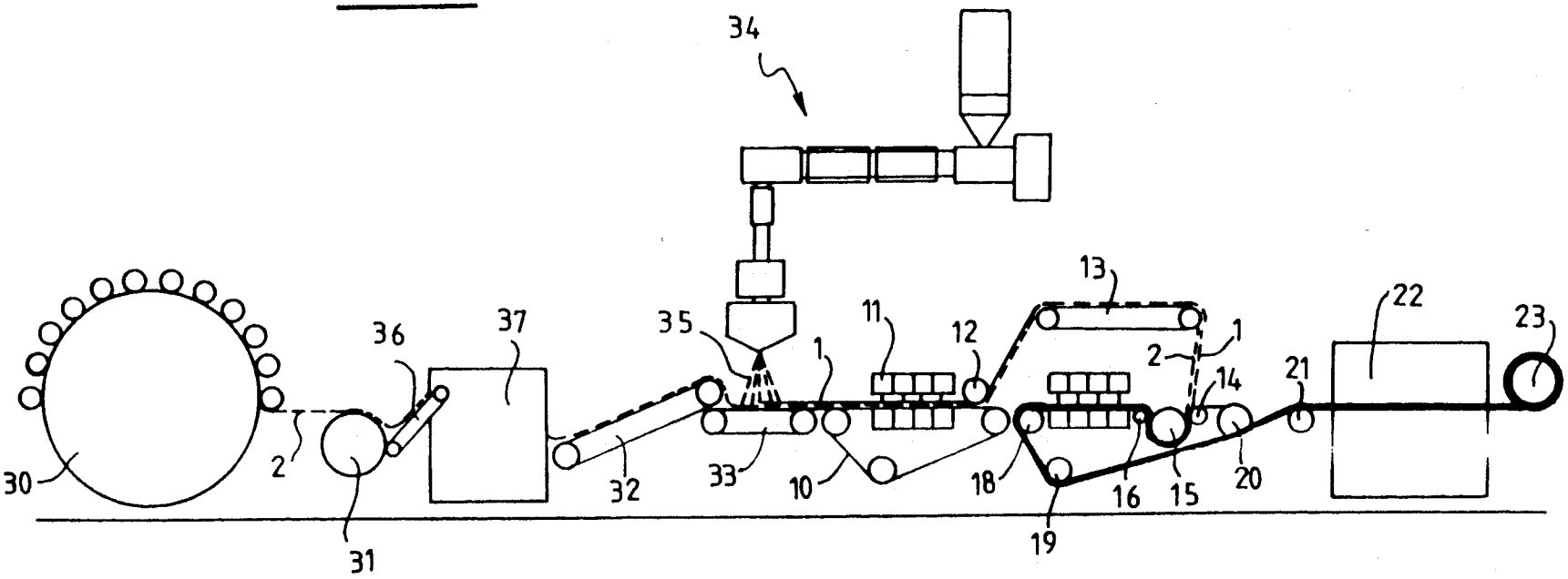
FIG. 3 is a diagrammatic representation of a second embodiment of the invention.

FIG. 3 illustrates a process for producing the lining, in which the second fiber lap 2 is a lap of fibers having an orientation crossed according to the desired properties. The lap of carded fibers 2, at the exit of the carding line 30, is presented to a folder/lapper 36, 37 which gives it its crossing. The second layer 2 is subsequently transferred to the belt 33 by the conveyor 32.

Figure 4:
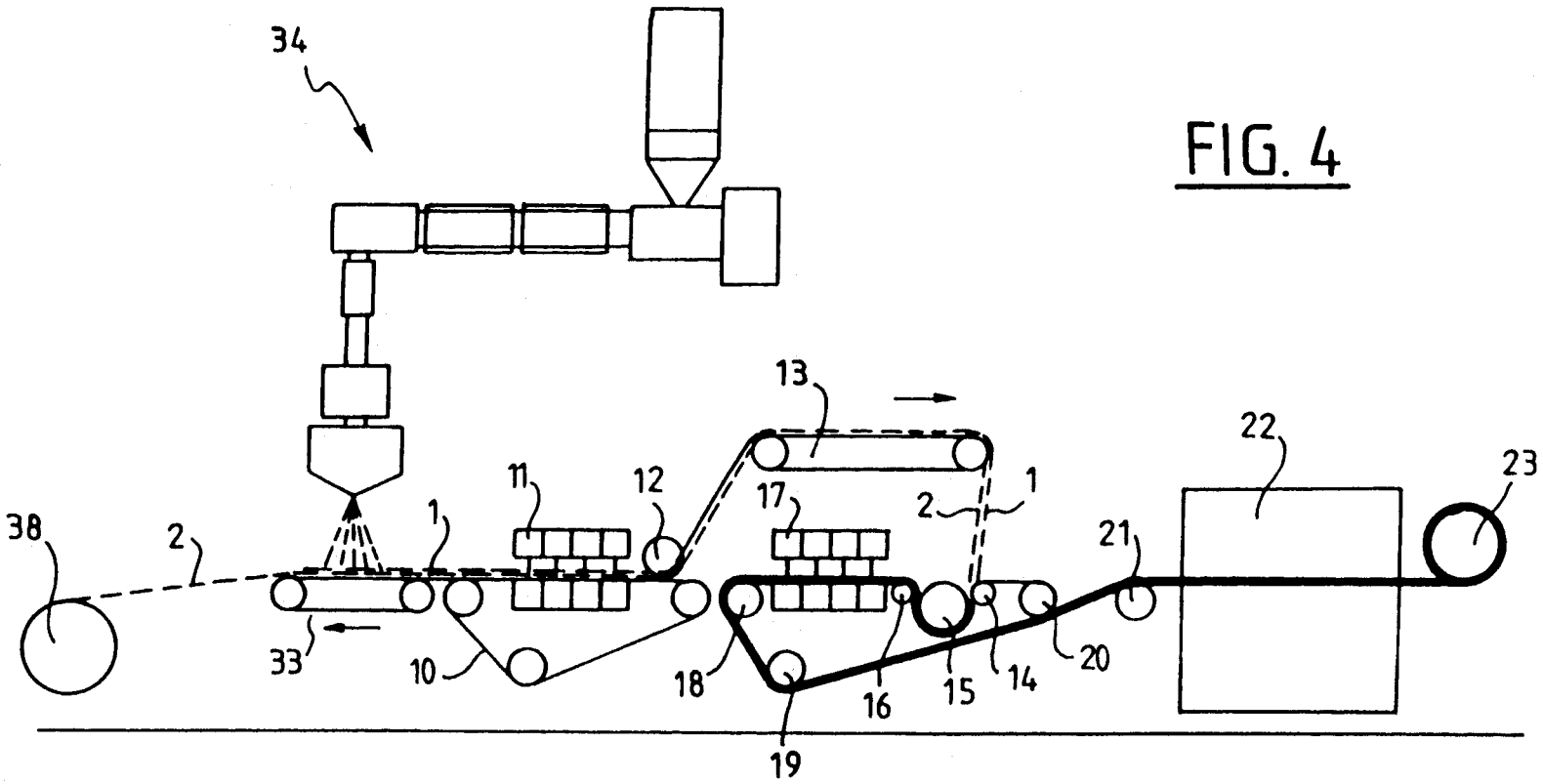
FIG. 4 is a diagrammatic representation of a third embodiment of the invention.

FIG. 4 illustrates a production process, in which the second layer 2 has been preneedled and then momentarily stored on the roller 38 which feeds the conveyor 33.

In this case, the preneedling can be carried out either by means of a mechanical needling machine or likewise by means of a system of fluid jets on a lap of carded fibers at the exit of the carding or carding/lapping line, so as to give the fiber voile a cohesion. This preneedling operation makes it possible to carry out the process of the invention discontinuously, separating the carding phase from the extrusion, melt-blowing and fluid-jet bonding operations.

Likewise, a nonwoven voile of synthetic filaments ("spunbond") has a cohesion sufficient for it to be stored on a roll.

Figure 5:
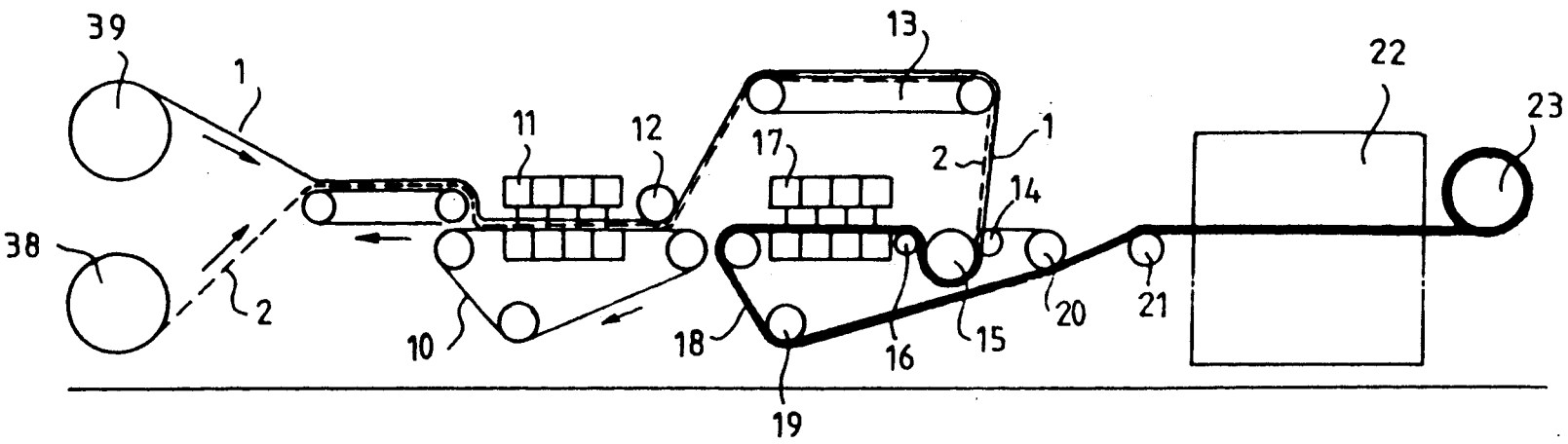
FIG. 5 is a diagrammatic representation of a fourth embodiment of the invention.

FIG. 5 illustrates an embodiment of the process, in which the first nonwoven layer of microfibers produced by the "melt-blown" process is itself previously produced and then wound on the roller 39. Thus, the production of the first "melt-blown" layer is dissociated from the execution of the invention, thereby allowing all the intermediate storages deemed expedient.

Figure 6:
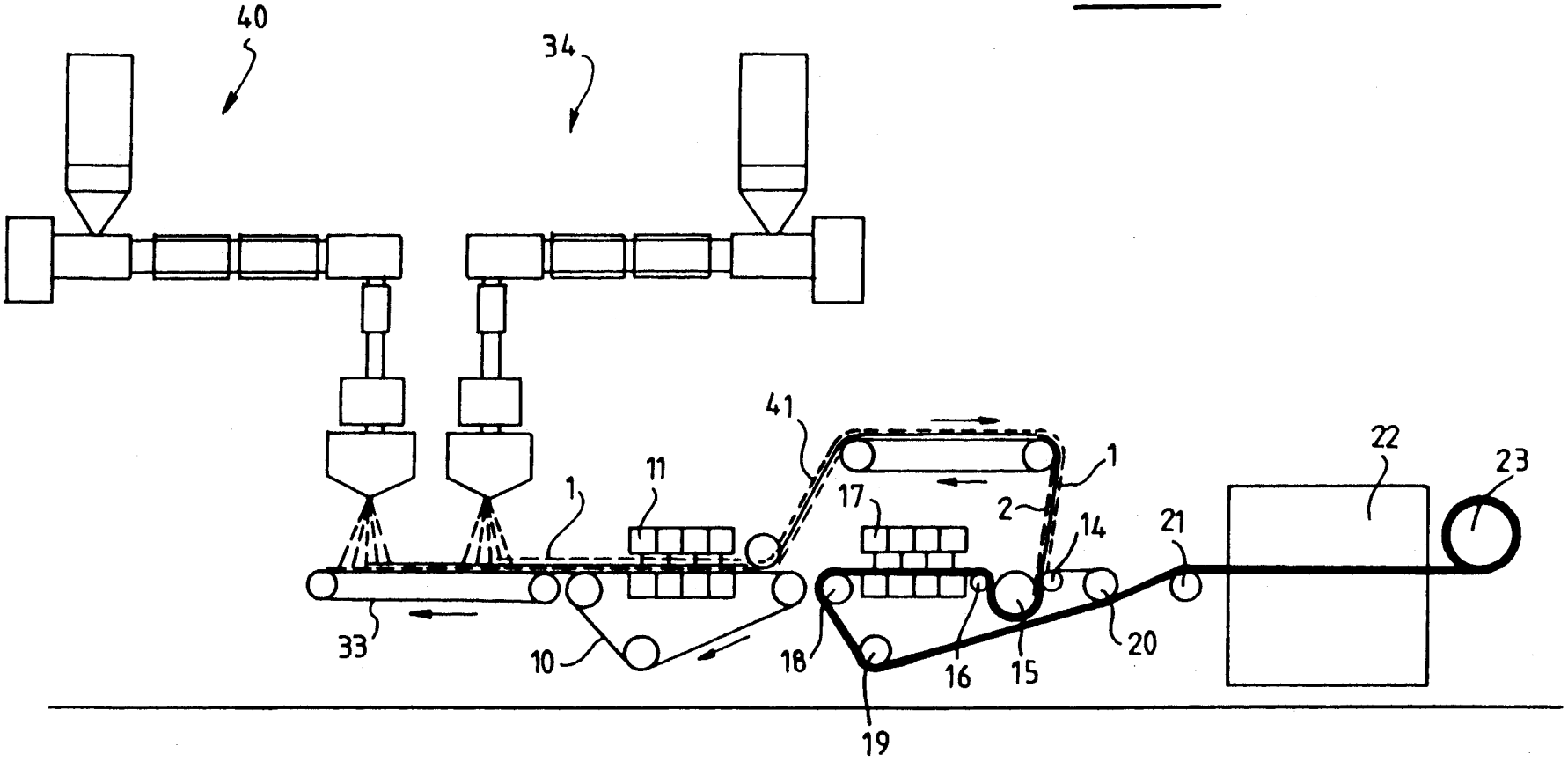
FIG. 6 is a diagrammatic representation of a fifth embodiment of the invention.

FIG. 6 illustrates a production process according to the invention, in which the second nonwoven layer 2 is formed directly on the belt 33 by the extruder 40 by the melted process ("spunbond") and is then associated with a layer produced by melt-blowing ("melt-blown") carried out by the extruder 34 directly on the second nonwoven layer 2.

The third layer 41 is deposited on the first nonwoven layer of microfibers 1, and the three layers 1, 2, 41 are all three associated together by means of the fluid jets produced by the injectors 11 and 17.

The structure of the composite lining of the invention enables an unrestricted choice of the nature and properties of each of these layers to be made and thereby a very extensive range of needs encountered in the sector of linings to be met.

I claim:

1. A lining fabric comprising a first nonwoven layer composed of microfibers produced by melt-blowing, and at least one second nonwoven layer composed of fibers or filaments and an adhesive layer distributed in spots, the first layer and the second layer being bonded, on the one hand, partially by the entanglement of some of fibers thereof by the application of fluid jets and, on the other hand, completely by the base of the spots of the adhesive layer which keeps the fibers interlaced, thus ensuring the cohesion of the assembly as a whole.

2. The lining fabric as claimed in claim 1, wherein the second nonwoven layer is composed of carded discontinuous fibers.

3. The lining fabric as claimed in claim 1, wherein the second nonwoven layer is composed of carded fibers bonded by thermal bonding.

4. The lining fabric as claimed in claim 1, wherein the second nonwoven layer is composed of needled carded fibers.

5. The lining fabric as claimed in claim 1, wherein the second layer consists of a nonwoven voile formed from synthetic continuous filaments intermingled without orientation and obtained by the melted process.

6. The lining fabric as claimed in claim 5, wherein the linear density of the filaments forming the second nonwoven layer is higher than 1.5 Dtex.

7. The lining fabric as claimed in claim 1, defined in that it comprises a third nonwoven layer consisting of synthetic continuous filaments obtained by the melted process and bonded to one of the other two layers by the entanglement of some of their fibers which is obtained by the application of fluid jets.

8. The lining fabric as claimed in claim 1, defined in that it comprises a third nonwoven layer bonded to one of the other two layers by the entanglement of some of their fibers which is obtained by the application of fluid jets.

* * * * *